US009462890B2

(12) United States Patent
Thomas

(10) Patent No.: US 9,462,890 B2
(45) Date of Patent: Oct. 11, 2016

(54) PORTABLE COMPOSITE SEAT

(71) Applicant: Arete Lyseis, LLC, Beaverton, OR (US)

(72) Inventor: Matthew Dean Thomas, Beaverton, OR (US)

(73) Assignee: Arete Lyseis, LLC, Beaverton, OR (US)

( * ) Notice: Subject to any disclaimer, the term of this patent is extended or adjusted under 35 U.S.C. 154(b) by 52 days.

(21) Appl. No.: 14/266,756

(22) Filed: Apr. 30, 2014

(65) Prior Publication Data

US 2015/0313365 A1 Nov. 5, 2015

(51) Int. Cl.

| | |
|---|---|
| ***A47C 1/16*** | (2006.01) |
| ***A47C 7/02*** | (2006.01) |
| ***A47C 7/18*** | (2006.01) |

(52) U.S. Cl.

CPC ..... *A47C 1/16* (2013.01); *A47C 7/021* (2013.01); *A47C 7/185* (2013.01)

(58) Field of Classification Search

CPC ..... A47C 7/021; A47C 1/16; A47C 7/185
USPC ..... 5/728
See application file for complete search history.

(56) References Cited

U.S. PATENT DOCUMENTS

| | | | | |
|---|---|---|---|---|
| 2,082,151 | A | 6/1937 | Poix | |
| 2,387,319 | A * | 10/1945 | Evans | 70/456 R |
| 3,280,410 | A | 10/1966 | Propst | |
| 3,393,012 | A | 7/1968 | Chancellor | |
| 3,512,190 | A | 5/1970 | Buff | |
| 3,606,777 | A * | 9/1971 | Watson | 70/458 |
| 4,660,238 | A | 4/1987 | Jay | |
| 4,689,829 | A * | 9/1987 | Kaplan | A41D 13/0537 2/46 |
| RE32,734 | E * | 8/1988 | McLeod | 5/722 |
| 4,930,171 | A * | 6/1990 | Frantz | A47C 7/021 297/DIG. 1 |
| D329,566 | S | 9/1992 | Davidson | |
| 5,160,785 | A | 11/1992 | Davidson | |
| D375,863 | S | 11/1996 | Bigolin | |
| 5,855,415 | A | 1/1999 | Lilley | |
| 5,921,626 | A | 7/1999 | Baker | |
| 6,009,578 | A | 1/2000 | Davis | |

(Continued)

FOREIGN PATENT DOCUMENTS

| | | | |
|---|---|---|---|
| AU | 2012100007 | B4 | 7/2012 |
| WO | WO2007007211 | A3 | 7/2007 |
| WO | WO2012170872 | A3 | 4/2013 |

OTHER PUBLICATIONS

Rogers Foam, (www.rogersfoam.com/materials/foam/), Retreived from archive.org (http://web.archive.org/web/20131127023338/http://www.rogersfoam.com/materials/foam/), Nov. 27, 2013.*

(Continued)

*Primary Examiner* — Nicholas Polito
*Assistant Examiner* — Eric Kurilla
(74) *Attorney, Agent, or Firm* — Fish & Richardson P.C.

(57) ABSTRACT

The present disclosure includes systems and techniques relating to stadium seats or a seat cushions composed of materials configured in a sandwich construction. In some implementations, an apparatus, systems, or methods can include a durable bottom layer that is adapted to provide traction on a bottom surface of the portable composite stadium seat cushion, an insulating core layer that is adapted to provide contoured and cushioned support for sitting on the portable composite stadium seat cushion, and a pliable top layer that is resilient and protects the core layer.

10 Claims, 5 Drawing Sheets

(56) References Cited

U.S. PATENT DOCUMENTS

| | | | | |
|---|---|---|---|---|
| D441,587 | S | 5/2001 | Cameron | |
| 6,357,829 | B1 | 3/2002 | Hanke | |
| D474,637 | S | 5/2003 | Scheetz | |
| 6,588,840 | B1 | 7/2003 | Lombardo | |
| 6,652,034 | B1 * | 11/2003 | Schramm et al. | 297/452.35 |
| 6,918,146 | B2 * | 7/2005 | England | 5/653 |
| 7,070,231 | B1 | 7/2006 | Wong | |
| 7,114,776 | B1 | 10/2006 | Wiltberger | |
| D540,097 | S | 4/2007 | Gebbia | |
| 7,574,760 | B2 | 8/2009 | Foley | |
| 7,695,069 | B2 | 4/2010 | Prust | |
| 7,774,880 | B1 * | 8/2010 | Botts | A47C 1/16 297/228.1 |
| 7,929,297 | B2 * | 4/2011 | Chen | H04M 1/026 310/215 |
| 8,032,949 | B1 * | 10/2011 | Matthews | A41D 1/04 2/102 |
| 8,199,492 | B2 * | 6/2012 | Liang | H04M 1/0202 242/164 |
| 8,209,804 | B2 * | 7/2012 | Apperson et al. | 5/691 |
| 8,696,059 | B2 | 4/2014 | Carmichael | |
| D705,533 | S * | 5/2014 | Tunney | D3/207 |
| D738,644 | S | 9/2015 | Reynolds | |
| 2006/0031994 | A1 | 2/2006 | Willat | |
| 2006/0185093 | A1 * | 8/2006 | Yu | 5/653 |
| 2007/0275827 | A1 | 11/2007 | Glaser | |
| 2007/0277352 | A1 * | 12/2007 | Maron | A45C 3/06 24/298 |
| 2008/0122267 | A1 | 5/2008 | Larson | |
| 2010/0146706 | A1 | 6/2010 | Siegner | |
| 2013/0257112 | A1 * | 10/2013 | Smith | 297/183.1 |
| 2014/0130265 | A1 * | 5/2014 | Lauer | A47C 27/144 5/716 |
| 2015/0108802 | A1 * | 4/2015 | Krishtul | 297/283.1 |

OTHER PUBLICATIONS

International Application No. PCT/US2015/028640, Notification of Transmittal of the International Search Report and the Written Opinion of the International Searching Authority, mailed Jul. 2, 2015, 10 pages.

Office Action Summary in U.S. Appl. No. 29/489,30, dated Nov. 12, 2015, 19 pages.

U.S. Appl. No. 29/489,630, filed May 1, 2014, entitled "Stadium Seat Cushion", 5 pages.

* cited by examiner

PORTABLE COMPOSITE SEAT

TECHNICAL FIELD

The subject matter of this application is generally related to composite stadium seats or a seat cushions composed of materials configured in a sandwich construction.

BACKGROUND

Many venues, such as events at sports and entertainment arenas or stadiums, provide inadequate seating arrangements (e.g., lack of insulation or cushioning), or no seating arrangements at all. For example, seats provided in stadiums or arenas are generally molded hard plastic that provides limited comfort and insulation.

Besides various medical issues that can arise, an otherwise enjoyable experience of attending such venues can be diminished by inadequate seating arrangements.

SUMMARY

The present disclosure includes systems and techniques related to portable composite stadium seats or a seat cushions composed of materials configured in a sandwich construction. According to an aspect of the described systems and techniques, a portable composite seat cushion includes a bottom layer including a durable material adapted to provide fraction on a bottom surface of the portable composite stadium seat cushion, a core layer including an insulating material, which is different than the durable material, where the insulating material is adapted to provide contoured and cushioned support for sitting on the portable composite stadium seat cushion, and a top layer including a pliable material, which is different than both the durable material and the insulating material, where the top layer is resilient and protects the core layer.

The foregoing and other embodiments can each optionally include one or more of the following features, alone or in combination. In some embodiments, the portable composite stadium seat cushion can further include a pocket insert that has a cavity with two opposing surfaces, where the pocket insert can be recessed into the core layer, and an attachment pin that can be coupled to the two opposing surfaces of the pocket insert. In some embodiments, the pocket insert can include a load distribution element, where the load distribution element can be embedded, at least in part, within the portable composite stadium seat cushion. In some embodiments, the load distribution element is ring shaped. In some embodiments, the load distribution element can be adapted to absorb tensile loads.

In some embodiments, the attachment pin can be integral to the pocket insert. In some embodiments, the portable composite stadium seat can include a front face and a rear face opposing the front face, where at least one of the bottom layer, the core layer, and the top layer can be configured such that the portable composite stadium seat is sloped downwards from the rear face towards the front face. In some embodiments, the portable composite stadium seat is rectangular. In some embodiments, the portable composite stadium seat has rounded corners. In some embodiments, the bottom surface of the portable composite stadium seat cushion has a traction pattern. In some embodiments, the pliable material of the top layer is durable, abrasion resistant, and waterproof. In some embodiments, the pliable material of the top layer is neoprene. In some embodiments, the insulating material of the core layer is closed cell foam.

In some embodiments, the durable material of the bottom layer is pliable, abrasion resistant, and waterproof. In some embodiments, the durable material of the bottom layer is rubber.

The systems and techniques described in this specification can be implemented so as to realize one or more of the following advantages. A stadium seat that features ergonomically contoured support for seating comfort and insulation from the surface on which the stadium seat is placed (e.g., insulation from cold or hot surfaces) can be provided. Additionally, a compact and portable stadium seat that can be attached to clothing (e.g., a belt or belt loops) or equipment (e.g., a backpack or a bag) via an attachment device (e.g., a carabineer, a clipping device, or a rope) can be provided.

Details of one or more implementations are set forth in the accompanying drawings and the description below. Other features, objects and advantages may be apparent from the description and drawings, and from the claims.

DRAWING DESCRIPTIONS

Like reference symbols in the various drawings indicate like elements.

DETAILED DESCRIPTION

Figure 1A:
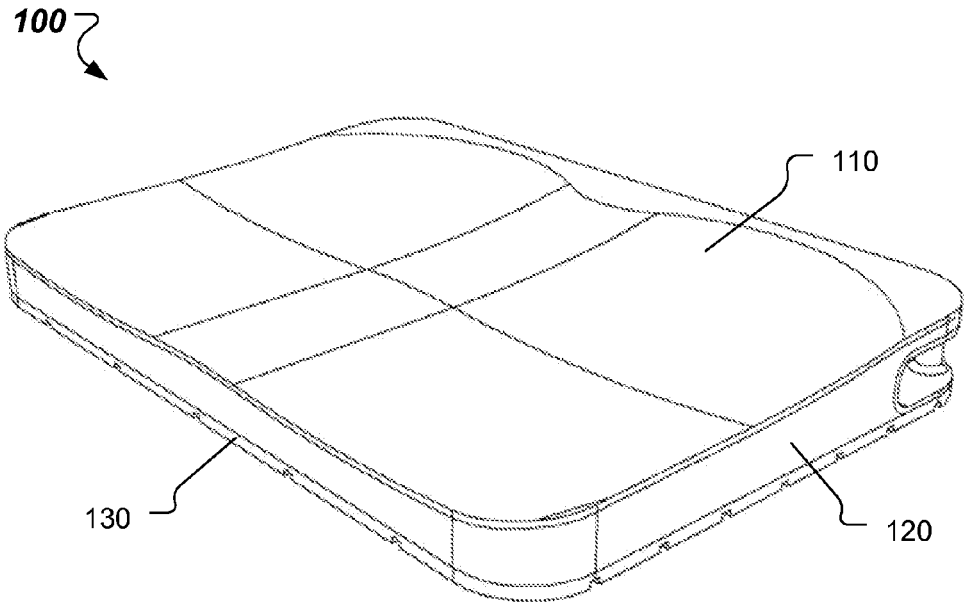
FIGS. 1A-1F are various views of an example of a composite stadium seat cushion.

The portable composite stadium seats or seat cushions described herein are compact, easily transportable, and convenient devices that include various features and qualities that are deficient or not found in other stadium seat cushions. The portable composite stadium seats or seat cushions can provide ergonomic comfort and support in addition to insulating features from temperatures of surfaces on which the composite stadium seat or seat cushion is placed.

The portable composite stadium seats or seat cushions feature a sandwich structure of materials serving several complimentary functions. The ergonomic features of the composite stadium seat or seat cushion can include a contoured shape that conforms to the human anatomy in the buttocks region and can be sloped downward from the back face of the seat cushion towards the front face of the seat or cushion to facilitate proper back posture when a person is in a seated position. Amongst other possible shapes, the composite stadium seats or seat cushions can be rectangular. In some implementations, the sandwich structure of the composite stadium seat or cushion includes three layers of material, a bottom layer, a top layer, and a core layer sandwiched between the bottom and the top layer.

FIGS. 1A-1F are various views of an example of a composite stadium seat cushion 100. In this embodiment, the composite stadium seat cushion 100 includes a bottom layer 130, a top layer 110, and a core layer 120 sandwiched between the bottom layer 130 and the top layer 110.

The top layer 110 is the element of the composite stadium seat cushion 100 on which a person can be seated. The top layer 110 can be formed from a pliable, durable, abrasion resistant, and/or waterproof material (e.g., neoprene.) The top layer 110 provides resiliency when subjected to continued and periodic use and when exposed to a variety of weather conditions. The top layer 110 partially protects the core layer 120 from exposure to ambient elements and from external contact related impact.

The core layer 120 is an insulating layer that is adapted to retain the ergonomic shape of the composite stadium seat cushion 100 while providing contoured and cushioned support for sitting on the composite stadium seat cushion. The core layer 120 can provide an insulating barrier from surface temperatures on which the composite stadium seat cushion 100 is placed. In some embodiments, the core layer 120 can be formed from a pliable and thermally insulating material (e.g., closed celled foam).

The bottom layer 130 can be formed from a pliable, durable, abrasion resistant, and/or waterproof material such as rubber (e.g., rubber used for athletic shoes.) The bottom layer 130 provides resiliency when subjected to continued and periodic use and when exposed to a variety of weather conditions. The bottom layer 130 can also provide traction when placed on a surface and partially protects the core layer 120 from exposure to ambient elements and from external contact related impact. In some embodiments, the bottom layer 130 has a bottom surface with a traction pattern (e.g., similar to fraction patterns of shoe soles).

In embodiments where the composite stadium seat cushion is sloped downward from the back face towards the front face (e.g., in angles of 1°, 2°, 3°, 4°, 5°, or more) the back face can have a height $H_1$ (e.g., of 1 inch, 1.25 inches, 1.5 inches, 1.75 inches, 2 inches, 2.25 inches, 2.5 inches, or more) and the front face can have a height $H_2$ (e.g., of 0.75 inches, 1 inch, 1.25 inches, 1.5 inches, 1.75 inches, 2 inches, or more) to facilitate proper back posture when a person is in a seated position.

Figure 1B:
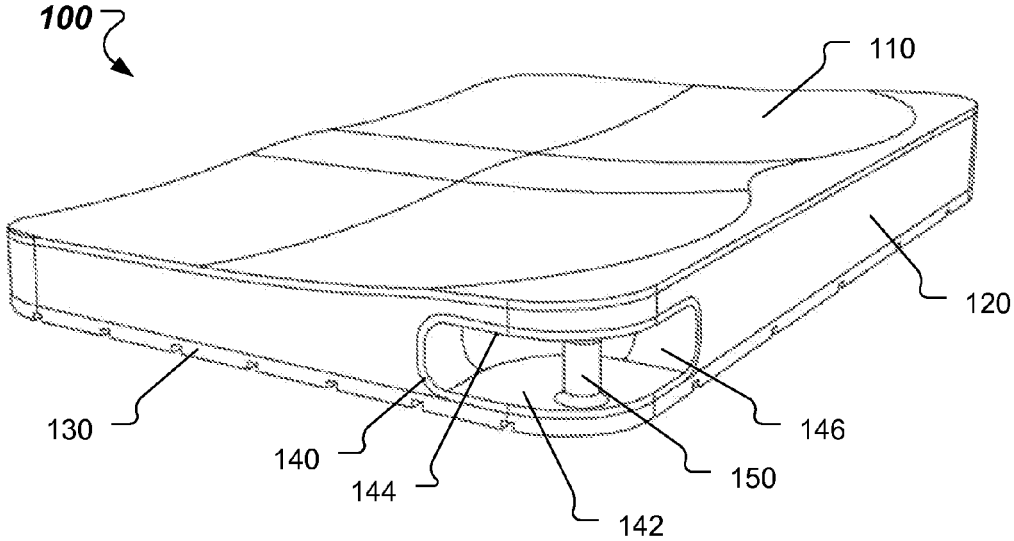

In some implementations, the composite stadium seat cushion 100 can include a pocket insert 140 and an attachment pin 150, as shown in FIG. 1B, to attach devices such as a carabineer or a clipping device for transporting the composite stadium seat cushion 100. In this example, the pocket insert 140 is located at a corner of the composite stadium seat cushion 100. In other embodiments, the pocket insert 140 can be located at other portions of the composite stadium seat cushion, such as the middle of a shorter one of the sides. The pocket insert 140 can be embedded in the core layer 120 and have a cavity 146 with an opening at one or more outside faces of the composite stadium seat cushion 140. The cavity 146 can have a height $H_p$ (e.g., 0.75 inches, 1 inch, 1.25 inches, 1.5 inches, or more) from the bottom surface 142 to the top surface 144 of the pocket insert 140 to accommodate an attachment device, for example.

The attachment pin 150 is coupled to the bottom surface 142 and the top surface 144 of the pocket insert 140 such that attachment devices can be hooked onto the attachment pin 150. In some embodiments, the attachment pin 150 is integral to the pocket insert 140. In some embodiments, the attachment pin 150 is a component separate from the pocket insert 140 and can be attached to the pocket insert via bolts, screws, rivets, or adhesive, for example.

Figure 2A:
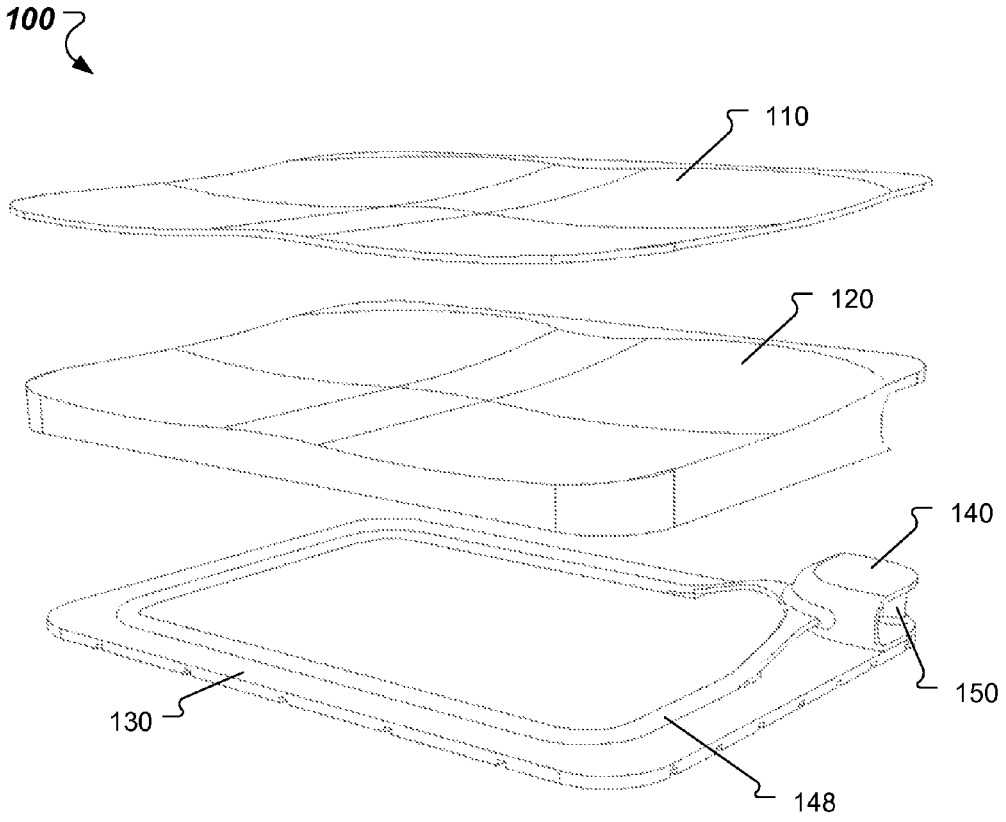
FIGS. 2A-2B are exploded views of an example of a composite stadium seat cushion.

In some embodiments, the composite stadium seat cushion 100 includes a load distribution element 148, as shown in FIG. 2A. The load distribution element 148 provides structural support and form stability for the composite stadium seat cushion 100. In some embodiments, the load distribution element 148 can be embedded within the core layer 120. In some embodiments, the load distribution element 148 can be placed between the bottom layer 130 and the core layer 120, or between the core layer 120 and the top layer 110 of the composite stadium seat cushion 100. In some embodiments, the load distribution element 148 can be ring shaped.

The load distribution element 148 can be coupled to the pocket insert 140 providing structural support when the pocket insert 140 is subjected to external loads (e.g., tensile loads) through attachment devices that are coupled with the attachment pin 150. The material used for the load distribution element can feature tensile and shear strength structural properties to withstand loads the composite stadium seat cushion is designed to endure. For example, when a concentrated tensile load is applied to the pocket insert, which may occur when the attachment device is subjected to a tensile load while the composite stadium seat cushion is constrained in some manner, the load path starts where the attachment pin is coupled with the pocket insert and is dispersed through the load distribution ring. The load path follows the load distribution ring along its longitudinal axis and gradually disperses to the enclosure material (e.g., the bottom, core, and/or top layer) via shear and normal load transfer. The load transfer can be achieved by bonding and geometric interfaces between the contiguous components. In implementations, where loads are transmitted from the load distribution ring to the core layer, the loads can be dispersed to the extent that the shear loads are below the core layer's yield shear values.

In some embodiments, the load distribution element 148 can be integral to the pocket insert 140. The load distribution element 148 can be formed from material, such as semi-rigid plastic, that does not crack or rupture when the composite stadium seat cushion 100 is rolled up or subjected to loads that are applied to the composite stadium seat cushion during ordinary use (e.g., sitting on or transporting the composite stadium seat cushion.)

While the composite stadium seat cushion 100 as shown in FIGS. 1 and 2 is rectangular (e.g., with a width W of 10 inches, 11 inches, 12 inches, 13 inches, 14 inches, or more, and a depth D of 7 inches, 8 inches, 9 inches, 10 inches, 11 inches, or more) with rounded corners, other shapes and configurations are also possible. For example, the composite stadium seat cushion can be circular, oval, triangular, octagonal, hexagonal, etc.

Figure 2B:
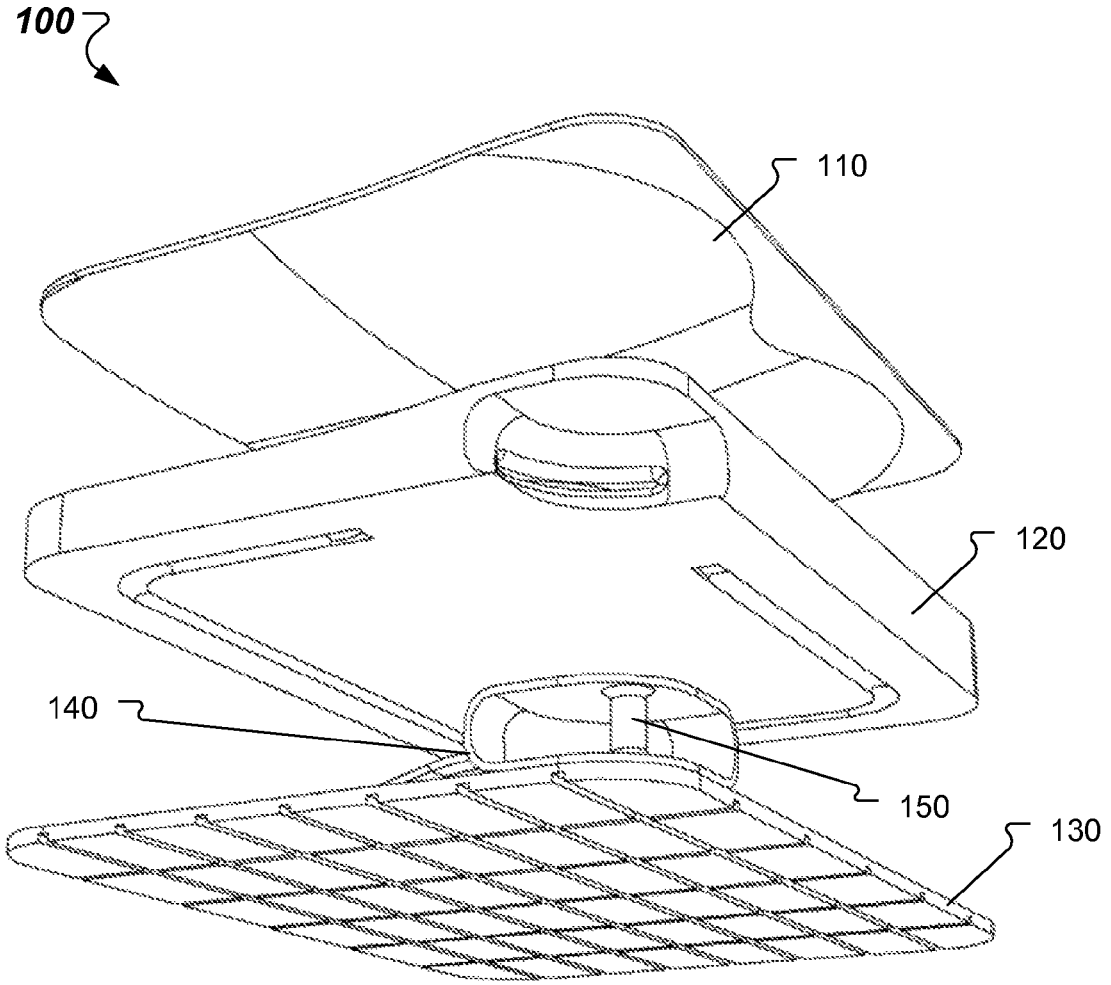

The described composite stadium seats or seat cushions can be fabricated by well-known methods, including injection molding, laminating, multiple axis milling, and 3D printing. For example, the individual elements of the composite stadium seats or seat cushions, such as the bottom layer, core layer, top layer, pocket insert, attachment pin, and/or load distribution element, can be formed separately, by injection molding. In some embodiments, various elements of the composite stadium seat or seat cushion can be integrally formed. For example, the attachment pin and/or load distribution element can be integral to the pocket insert. FIGS. 2A and 2B illustrate an example of separately formed elements of the composite stadium seats or seat cushions.

Figure 1C:
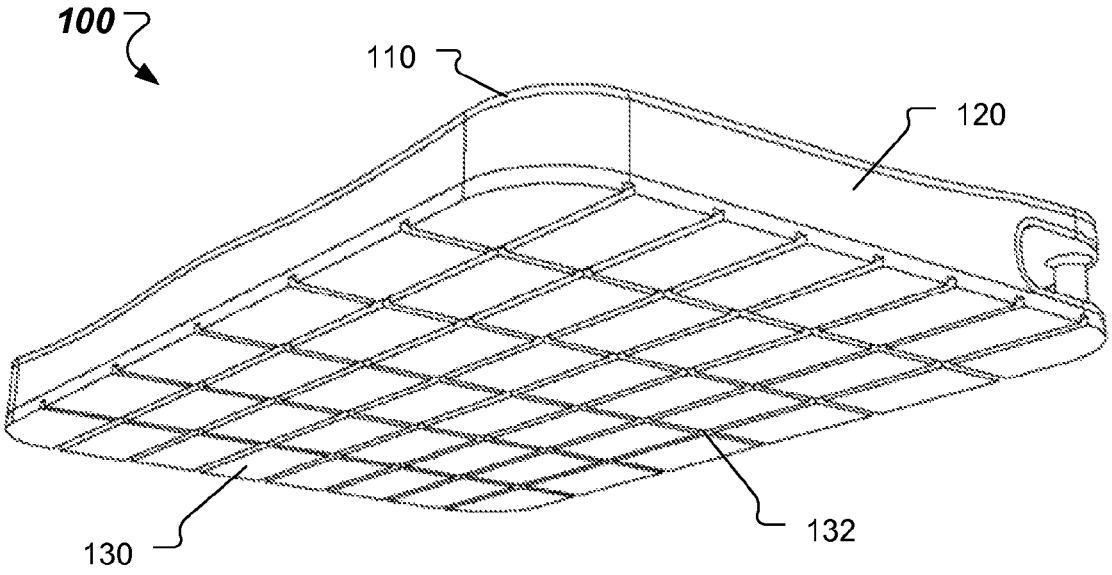
Figure 1D:
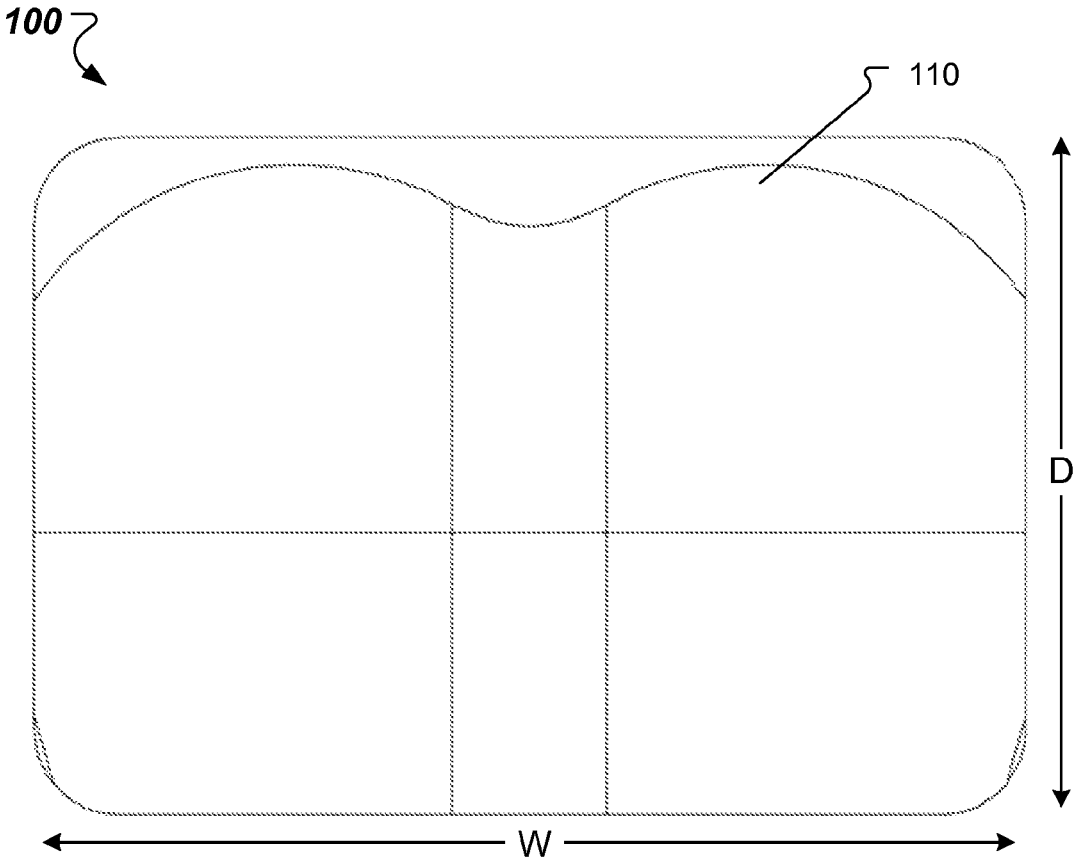
Figure 1E:
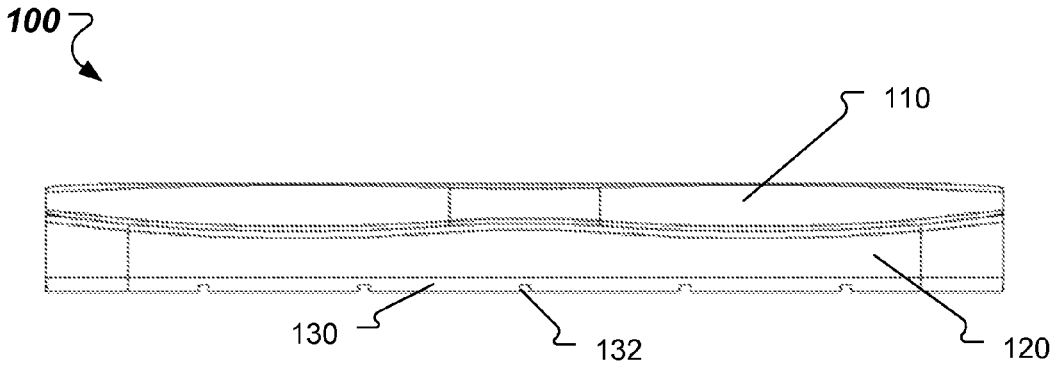
Figure 1F:
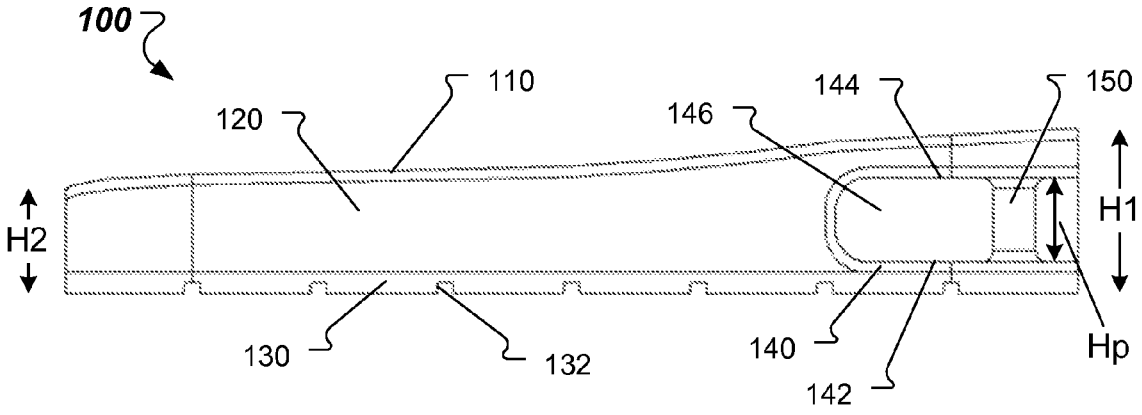

In some embodiments, the top layer 110 can be injection molded from material such as neoprene. The material properties of the molded top layer 110 can include non-marking, weather resistant, and suitable for indoor and outdoor use. The bottom layer 130 can be injection molded from material such as rubber. The material properties of the molded bottom layer 130 can include non-marking, weather resistant, suitable for indoor and outdoor use, and a high durometer or hardness (e.g., comparable to a durometer of rubber found in shoe soles.) In some embodiments, the bottom layer 130 includes a traction pattern on the bottom surface 132 (e.g., a tread like pattern) to provide traction when placed on a surface, as shown in FIGS. 1C, 1E, and 1F.

The pocket insert 140 and the load distribution element 148 can be injection molded from material such as plastic.

The material properties of the molded pocket insert 140 and the load distribution element 148 can include non-marking, weather resistant, and suitable for indoor and outdoor use. In some embodiments, the load distribution element 148 is attached to the center of the pocket insert 140, as shown in FIG. 2A, to position the attachment location at about the neutral axis of the composite stadium seat cushion 100. This configuration can reduce eccentric loading that may otherwise cause discomfort or premature wear when seated on uneven surfaces, for example. In some embodiments, the load distribution element 148 is integral to the pocket insert 140.

The attachment pin 150 can be injection molded from material such as plastic with properties similar to the pocket insert 140. The attachment pin 150 can be integral to the pocket insert 140 or a separate component. In embodiments where the attachment pin 150 is a separate component, the attachment pin 150 can be coupled to the pocket insert, for example, via attachment hardware, such as screws, bolts, rivets, etc., or bonded via adhesives. In some implementations, the attachment pin may also be screwed in or inserted into a slot and secured with an adhesive. In some embodiments, the attachment pin 150 can be fabricated from a durable material, such as plastic, fiber reinforced plastic (FRP), steel, or aluminum, for example.

The core layer 120 can be injection molded from material such as closed cell foam (e.g., medium density closed cell foam.) The material of the core layer 120 can include thermally insulating properties suitable for indoor and outdoor use. The core layer 120 can be lightly compressible to provide comfort, but generally retain its shape to provide structural support for the composite stadium seat cushion 100. For example, the material of the core layer 120 can feature elastic properties that allow compression with minimal strain or low percentage of deformation from the original shape of the core layer.

In some embodiments, the pocket insert 140 and/or the load distribution element 148 are embedded in the core layer 120. The pocket insert 140 and/or the load distribution element 148 can be placed and secured within the mold for the core layer 120. During the injection molding process of the core layer 120, the injected material encases, at least partially, the pocket insert 140 and/or the load distribution element 148.

The separately fabricated elements of the composite stadium seat or seat cushion can be bonded together, for example by using an adhesive (e.g., cement or adhesive used for bonding components of a shoe to each other.) In the assembled configuration, the top layer 110 and the bottom layer 130 can provide the rigid portion of the composite stadium seat 100, while the core layer 120 provides the softer portion. This sandwich configuration can provide benefits such as load distribution that results in substantially uniform support when seated on a level or uneven surface and protection from external wear and tear (primarily by the bottom and top layers) while achieving thermal insulation from surfaces on which the composite stadium seat cushion is placed (primarily by the core layer.)

It is noted that the described embodiments of a composite stadium seat or seat cushion described herein are exemplary and different variations in structure, design, application and methodology are possible.

What is claimed is:

1. A portable composite stadium seat cushion comprising:

a bottom layer comprising a durable material adapted to provide traction on a bottom surface of the portable composite stadium seat cushion;

a core layer comprising an insulating material, which is different than the durable material, the insulating material adapted to provide contoured and cushioned support for sitting on the portable composite stadium seat cushion;

a top layer comprising a pliable material, which is different than both the durable material and the insulating material, wherein the top layer is resilient and protects the core layer;

a pocket insert having a cavity including two opposing surfaces, the pocket insert being recessed into the core layer and comprising a load distribution element, the load distribution element being ring shaped and embedded, at least in part, within the portable composite stadium seat cushion; and an attachment pin coupled to the two opposing surfaces of the pocket insert.

2. The portable composite stadium seat of claim 1, wherein the load distribution element is adapted to absorb tensile loads.

3. The portable composite stadium seat of claim 1, wherein the attachment pin is integral to the pocket insert.

4. The portable composite stadium seat of claim 1, wherein the portable composite stadium seat comprises a front face and a rear face opposing the front face, and wherein at least one of the bottom layer, the core layer, and the top layer is configured such that the portable composite stadium seat is sloped downwards from the rear face towards the front face.

5. The portable composite stadium seat of claim 1, wherein the bottom surface of the portable composite stadium seat cushion has a traction pattern.

6. The portable composite stadium seat of claim 1, wherein the pliable material of the top layer is durable, abrasion resistant, and waterproof.

7. The portable composite stadium seat of claim 1, wherein the pliable material of the top layer is neoprene.

8. The portable composite stadium seat of claim 1, wherein the insulating material of the core layer is closed cell foam.

9. The portable composite stadium seat of claim 1, wherein the durable material of the bottom layer is pliable, abrasion resistant, and waterproof.

10. The portable composite stadium seat of claim 1, wherein the durable material of the bottom layer is rubber.

* * * * *